US005905240A

United States Patent [19]

Robarge et al.

[11] Patent Number: 5,905,240

[45] Date of Patent: May 18, 1999

[54] CONTACT CLOSING SOLENOID ASSEMBLY FOR AIR CIRCUIT BREAKERS

[75] Inventors: Dean A. Robarge, Southington; James L. Rosen, West Hartford, both of Conn.

[73] Assignee: General Electric Company, Schenectady, N.Y.

[21] Appl. No.: 08/944,748

[22] Filed: Oct. 6, 1997

[51] Int. Cl.[6] ..... H01H 5/00

[52] U.S. Cl. ..... 200/400; 335/75

[58] Field of Search ..... 200/400, 120–123; 335/167–172, 185–190, 75–76, 120–123

[56] References Cited

U.S. PATENT DOCUMENTS 3,084,238 4/1963 Baskerville .
3,095,489 6/1963 Baird .
3,729,065 4/1973 Baskerville et al. .
4,167,988 9/1979 Acampora et al. .
4,475,021 10/1984 Mochizuki et al. .
4,672,501 6/1987 Bilac et al. .
5,488,211 1/1996 Castonguay et al. ..... 200/400

*Primary Examiner*—Lincoln Donovan
*Attorney, Agent, or Firm*—Cantor Colburn LLP; Carl B. Horton

[57] ABSTRACT

A circuit breaker contact closing solenoid assembly within an air circuit breaker includes an upper drive link connecting between a lower drive link and the circuit breaker closing prop driver to release the closing prop driver post from the charging ratchet retainer post. Actuation of the circuit breaker closing solenoid rotates the upper and lower links to allow the charging ratchet to rotate and release the charged closing springs and drive the circuit breaker contacts to the CLOSED condition.

8 Claims, 5 Drawing Sheets

CONTACT CLOSING SOLENOID ASSEMBLY FOR AIR CIRCUIT BREAKERS

BACKGROUND OF THE INVENTION

Air circuit breakers as described within U.S. Pat. Nos. 3,095,489 entitled "Manual Charging Means for Stored Energy Closing Mechanisms of Electric Circuit Breakers" and 3,084,238 entitled "Ratchet Mechanism for Charging a Closing Spring in an Electric Circuit Breaker" include operating mechanisms that are mainly exposed to the environment. Since the air circuit breakers are rated to carry several thousand amperes of current continuously, the exposure to convection cooling air assists in keeping the operating components within reasonable temperature limits.

Such air circuit breakers are usually provided with a motor operator such as described in U.S. Pat. No. 4,167,988 entitled "Ratcheting Mechanism for Circuit Breaker Motor Operator" or a manual handle as described in U.S. Pat. No. 3,729,065 entitled "Means for Charging A Stored Energy Circuit Breaker Closing Device" for charging the powerful closing springs contained within the air circuit breaker operating mechanism.

As described within the aforementioned U.S. Pat. No. 4,167,988, the ratchet mechanism includes a driving pawl coupled with the motor operator for incrementally advancing a ratchet wheel coupled with the circuit breaker operating mechanism. The patent further suggests the use of a holding prop to hold the pawls out of engagement with the ratchet wheel until the closing springs have fully discharged to protect the pawls and the ratchet wheel from potential damage. When the contacts have become closed, the circuit breaker operating mechanism components are exposed to allow an operator to manually release the holding prop in order for the holding pawl to again become operative in recharging the circuit breaker closing spring.

When the circuit breaker closing springs are brought to their fully-charged conditions, it is important that the springs do not become inadvertently discharged while an operator has hold of the charging handle in order to avoid damage to the ratchet mechanism and the associated air circuit breaker contacts. An early arrangement of a latching means to prevent rotation of a closing springs charging handle is found in U.S. Pat. No. 4,475,021 entitled "Air Circuit Breaker". A more recent arrangement is found in U.S. patent application Ser. No. 08/878,596 entitled "Circuit Breaker Operating Handle Torque Compensation Module" filed on Jun. 19, 1997.

With such circuit breakers having their contacts in the OPEN position and the closing springs fully charged, a manual closing button or a remotely-controlled closing solenoid, interacts with the holding prop described earlier, to allow the closing springs to become released from the holding prop and drive the contacts to the CLOSED position.

One purpose of the invention, accordingly, is to describe an arrangement whereby the closing button and the closing solenoid are enabled to displace the holding prop and allow the contacts to become driven to the CLOSED position.

SUMMARY OF THE INVENTION

A circuit breaker contact closing solenoid assembly within an air circuit breaker includes an upper drive link connecting between a lower drive link and the circuit breaker closing prop driver to release the closing prop driver post from the circuit breaker charging ratchet retainer post.

The lower drive link connects between the upper drive link and the circuit breaker contact spring closing solenoid. Actuation of the closing solenoid rotates the upper and lower links to allow the charging ratchet to rotate and release the charged circuit breaker contact closing springs and drive the circuit breaker contacts to the CLOSED condition.

DESCRIPTION OF THE PREFERRED EMBODIMENT

Figure 1:
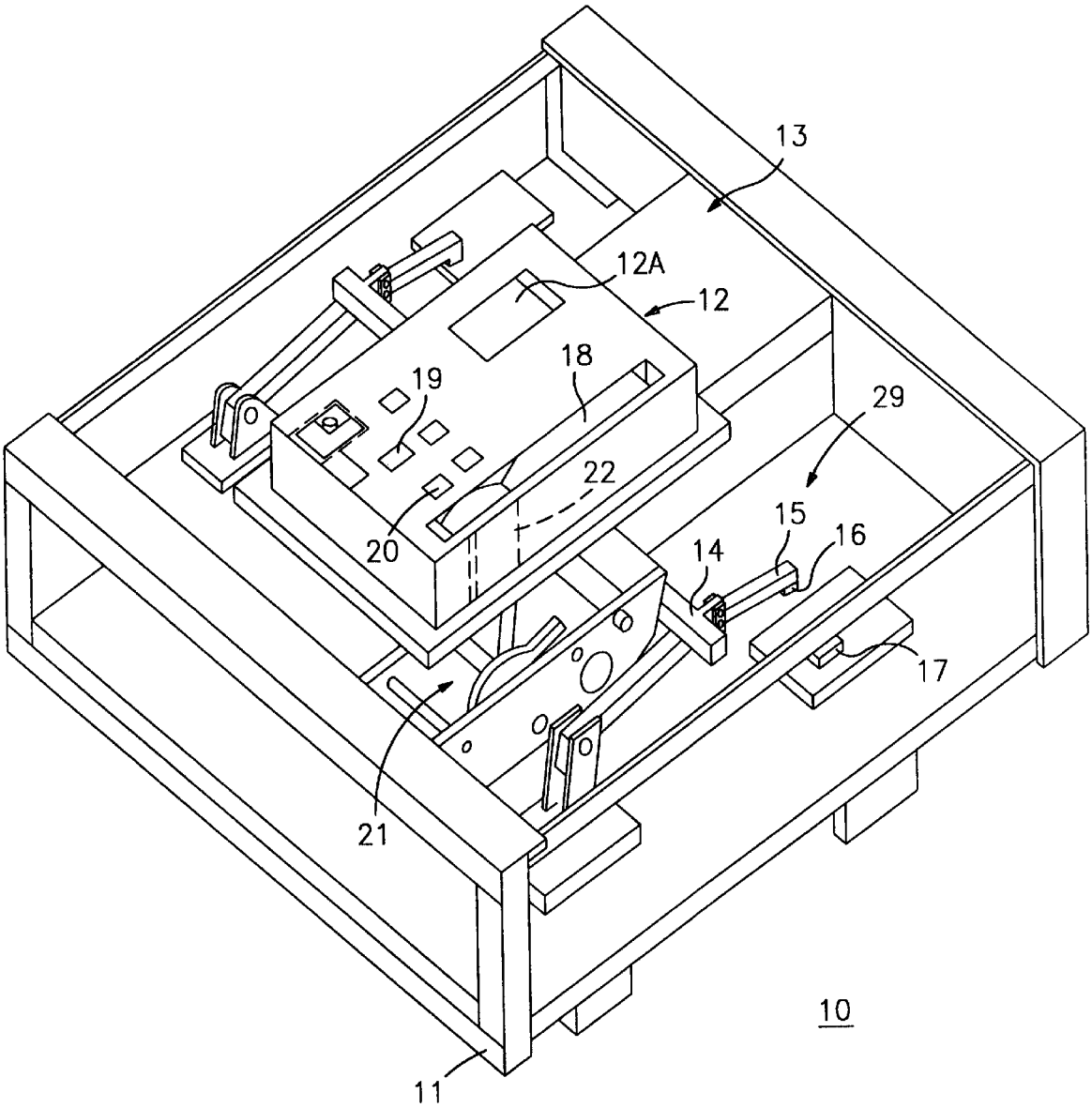
FIG. 1 is top perspective view of an air circuit breaker containing the circuit breaker contact closing solenoid assembly according to the invention.

The air circuit breaker 10 of FIG. 1 is similar to that described within the aforementioned U.S. Pat. No. 3,095,489 and includes a metal frame 11 which supports circuit breaker cover 12, the trip unit programmer 12 A is arranged on the top plate 25 (FIG. 2) of the operating mechanism enclosure 13. The trip unit programmer is similar to that described in U.S. Pat. No. 4,672,501 entitled "Circuit Breaker and Protective Relay Unit". The cover further includes a trip button 19 for releasing the circuit breaker operating mechanism contained within the cover 12 for separating the circuit breaker contacts 16, 17 within the contact assembly 29 to their open condition and a closing button, hereinafter "push button 20" for moving the contacts to their closed position. The circuit breaker contact arms 15 within each pole of a three pole circuit arrangement, are interconnected by means of the operating mechanism cross-bar 14 to insure that all contacts within the separate poles both open and close in unison. The circuit breaker operating mechanism 21 includes the closing springs closing ratchet mechanism described earlier and the operating handle 18 interacts with the ratchet mechanism by means of a pair of plate connectors, one of which is indicated at 22.

Figure 2:
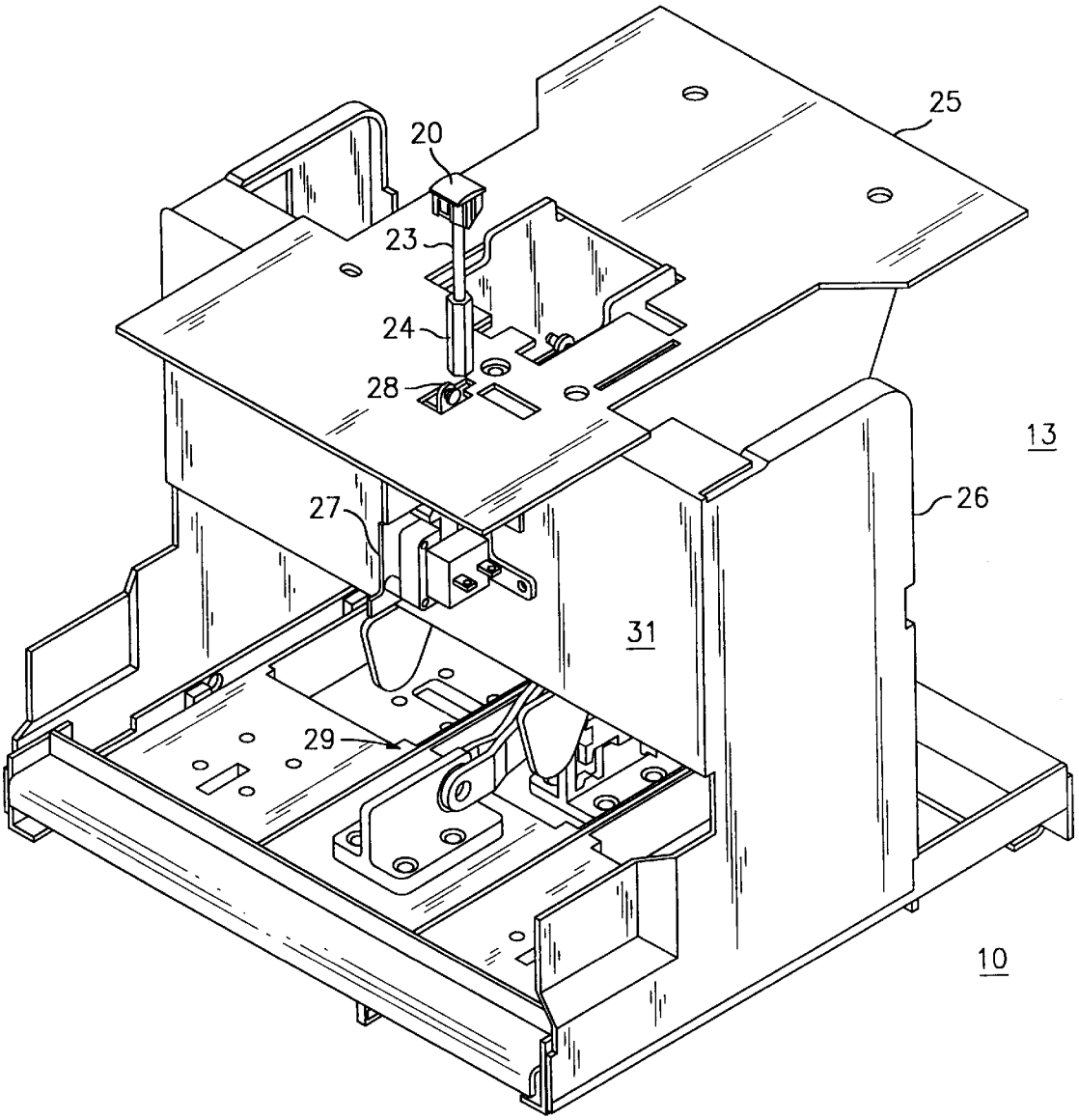
FIG. 2 is an enlarged top perspective view of the circuit of FIG. 1 with the circuit breaker cover removed to depict the circuit breaker contact closing solenoid assembly.
Figure 3:
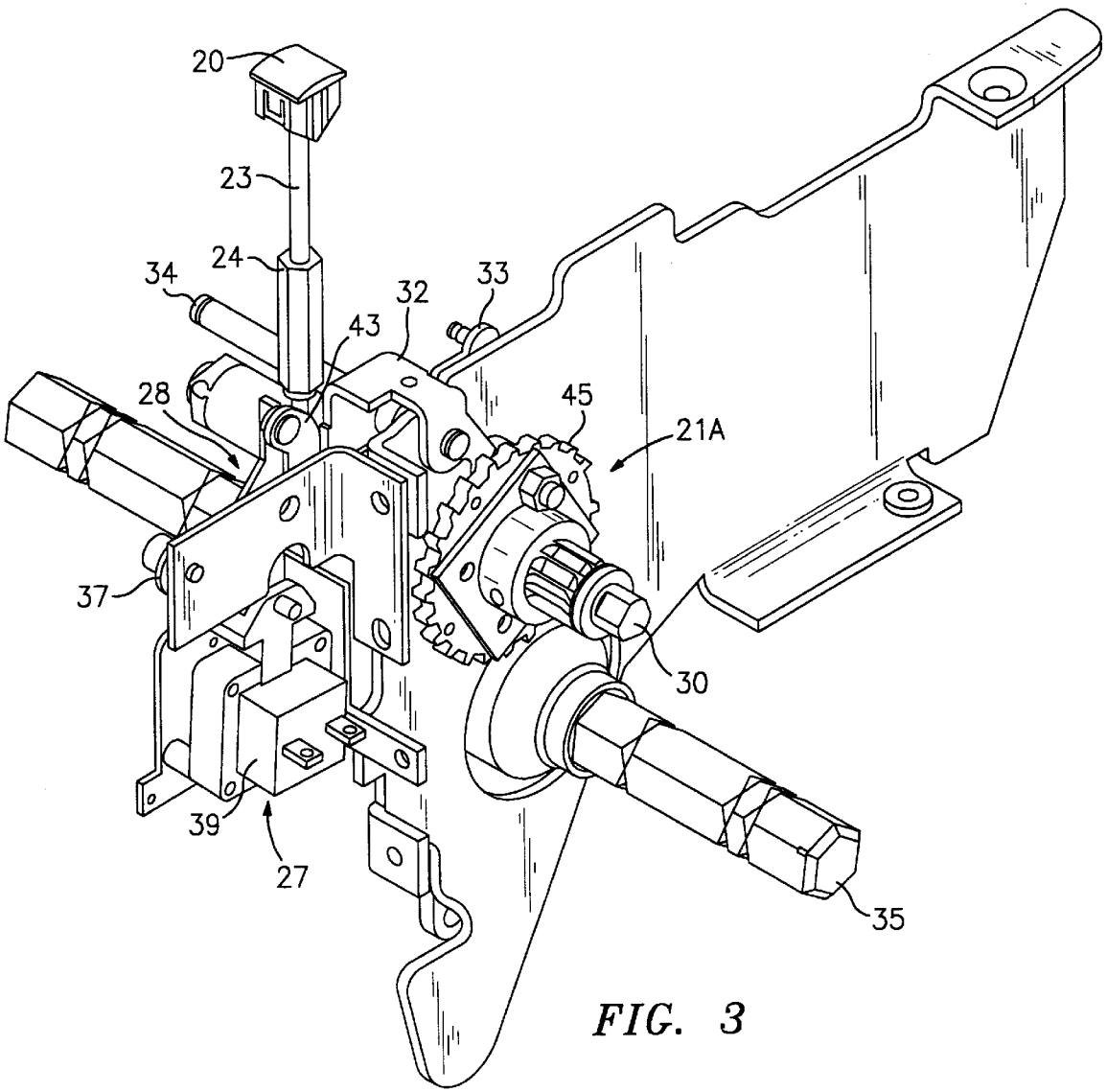
FIG. 3 is an enlarged top perspective view of the circuit breaker contact closing solenoid assembly apart from the circuit breaker of FIG. 2.

The circuit breaker 10 is shown in FIG. 2 with the circuit breaker cover 12, cross bar 14, contact arm 15 and the contacts 16, 17 in the outer poles within the contact assembly 29 removed to detail the arrangement of the push button 20 in relation to the top plate 25 of the operating mechanism enclosure 13 and the operating mechanism side frame 26. The push rod 23 extends from the circuit breaker closing springs push button 20 through the push rod guide 24 into contact with the closing solenoid assembly 27 attached to the operating mechanism cross frame 31, that interacts with the closing prop release assembly 28 in the manner best seen by now referring to the contact closing assembly 21A shown in FIG. 3.

Figure 6:
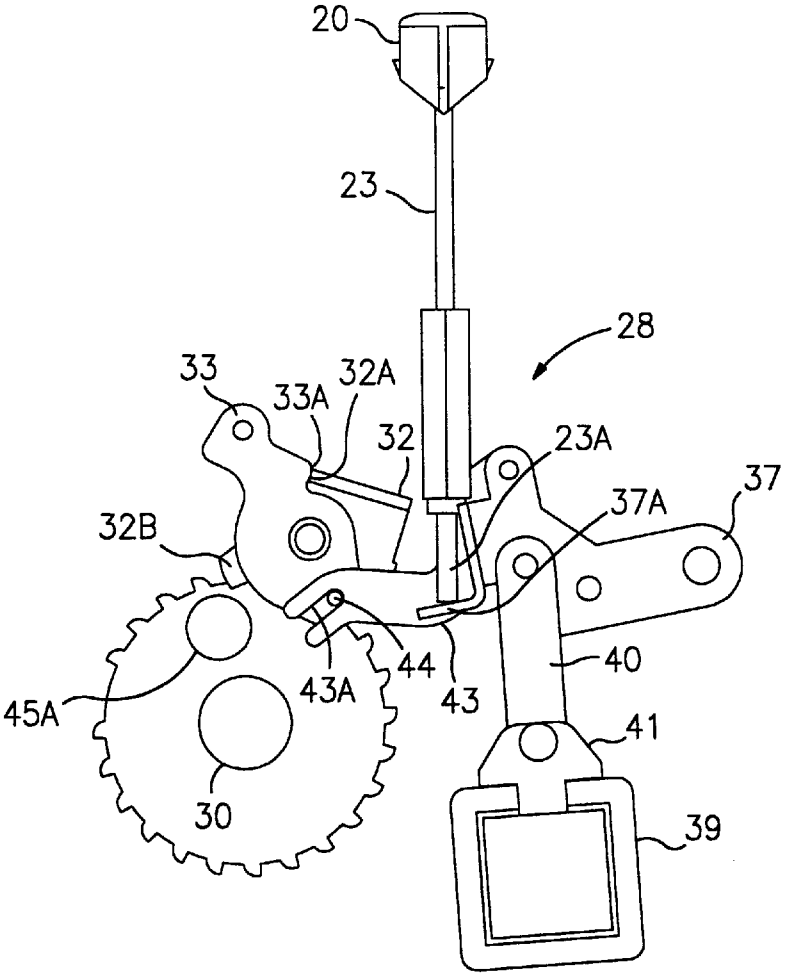
FIG. 6 is an enlarged side view of the closing prop release assembly of FIGS. 4 and 5 depicting the contact closing push button in a home position and the circuit breaker closing spring closing ratchet in a released condition.

Circuit breaker closing springs 60, as diagramatically indicated at 62 in FIG. 6, are charged in the manner described in the aforementioned U.S. patent application Ser. No. 08/878,596 which employs a contact closing assembly 21A including a similar closing shaft 35, closing prop 32, closing prop driver 33, closing prop shaft 34, charging ratchet 45 and charging shaft 30. The push button 20 has an attached push rod 23 extending through the push rod guide 24 into contact with the closing prop release assembly 28 that includes the lower and upper drive links 37, 43 and the solenoid assembly 27 that includes the closing solenoid 39.

Figure 4B:
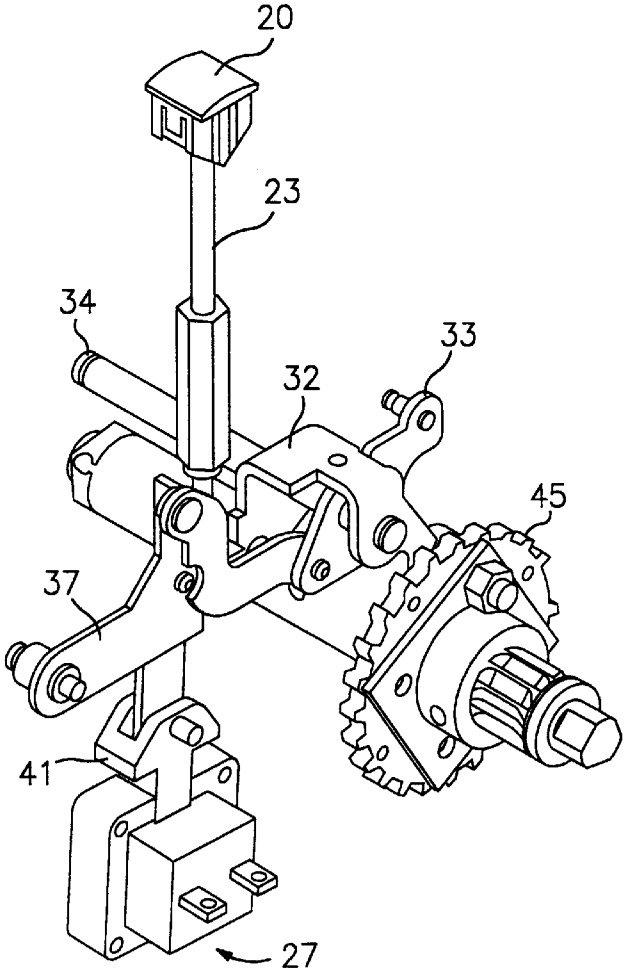
FIGS. 4A and 4B are front perspective views of the closing prop release assembly apart from the circuit breaker contact closing solenoid assembly of FIG. 3.
Figure 4A:
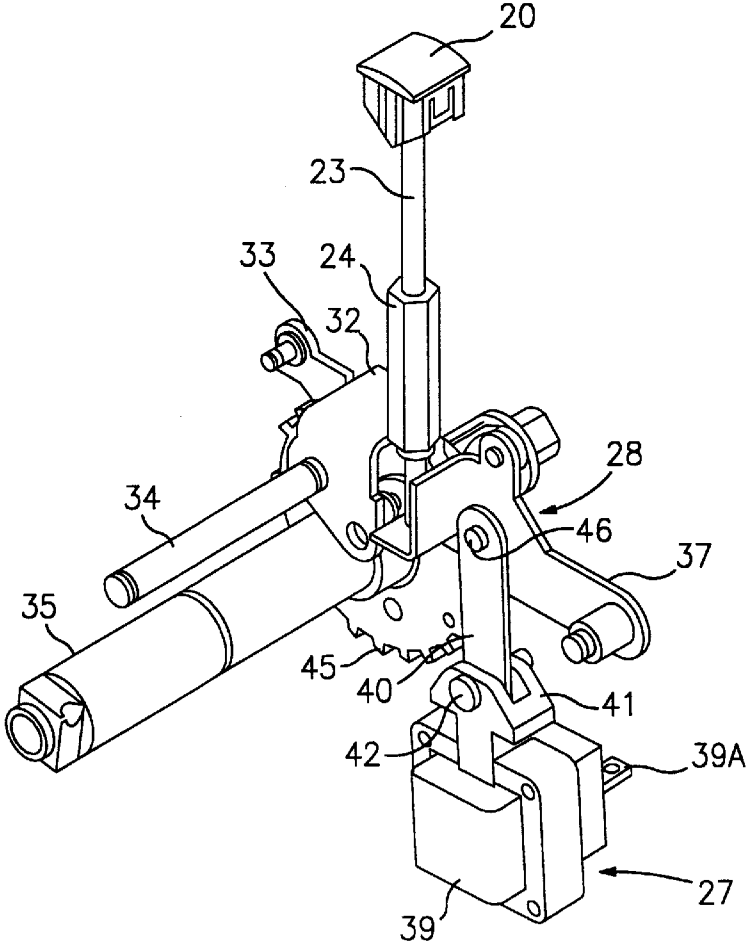

The closing prop release assembly 28 is best seen by referring to both FIG. 4A and FIG. 4B where a part of the closing prop shaft 34, closing shaft 35, charging ratchet 45, closing prop 32 and closing prop driver 33 are included to show the interaction with the closing prop release assembly 28. Also depicted is the push button 20, push rod 23, push rod guide 24 along with the closing solenoid assembly 27 to show the positional relationship between the various components contained therein. The solenoid 39 is of the type having a pair of electrical connectors 39A for receiving an external operating signal and a solenoid plunger 41 connecting with the solenoid connecting link 40 by means of a pin 42 at one end and with the lower drive link 37 by means of pin 46 at an opposite end thereof.

Figure 5:
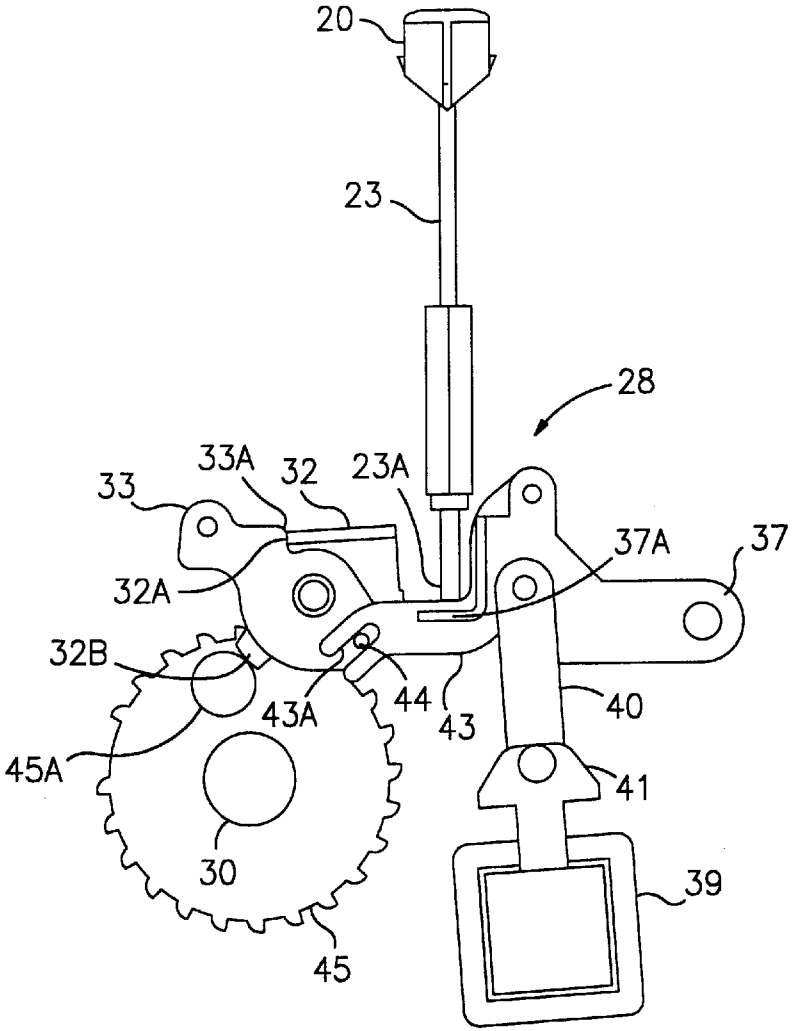
FIG. 5 is an enlarged side view of the closing prop release assembly of FIGS. 4 and 5 depicting the contact closing push button in a home position and the circuit breaker closing spring closing ratchet in a stopped condition.

FIG. 5 shows the closing prop release assembly 28 with the contact closing springs (not shown) in the fully charged condition and with the end 23A of the push rod 23 away from the bent tab 37A on the lower drive link 37. This is the home position of the push button 20 with the closing prop driver pin 44 on the closing prop driver 33 trapped within the slot 43A on the end of the upper drive link 43. The closing prop post 32B on top of the closing prop 32 abuts against the charging ratchet post 45A extending from the charging ratchet 45 on the charging shaft 30 and the end 32A of the closing prop 32 abuts against the detent surface 33A on the top of the closing prop driver 33. This arrangement insures that the closing ratchet 45 is unable to rotate to release the associated circuit breaker closing springs. In the OPEN condition of the circuit breaker contacts 16, 17 shown in FIG. 1, the closing solenoid 39 is deenergized such that the solenoid plunger 41 and attached solenoid link 40 remain extended.

FIG. 6 shows the closing prop release assembly 28 with the contact closing springs (not shown) in the released condition and with the end 23A of the push rod 23 in contact with the bent tab 37A on the lower drive link 37 in the active position of the push button 20. The solenoid 39 is actuated such that the solenoid plunger 41 retracts and drives the attached solenoid connecting link 40 which rotates the lower drive link 37 and the attached upper drive link 43. The rotation of the upper link in the counter-clockwise direction rotates the closing prop driver 33 in the clockwise direction by interaction between the prop driver pin 44 with the upper drive link slot 43A to remove the closing prop post 32B away from the charging ratchet post 45A allowing the charging shaft 30 to rotate and release the contact closing springs. It is noted that the end 32A of the closing prop 32 remains in contact with the closing prop driver detent surface 33A as the closing prop driver 33 rotates in the clockwise direction. This allows the closing prop driver 33 to return to the home position shown in FIG. 6 when the closing solenoid 39 is de-energized and the solenoid plunger 41 and solenoid connecting link 40 rotate the lower drive link 37 and attached upper drive link 43 in the counter-clockwise direction.

What is claimed is:

1. A circuit breaker contact spring release assembly comprising:

a closing solenoid having a solenoid plunger and a solenoid connecting link attached to said solenoid plunger at one end;

a pair of first and second drive links connected to each other at first ends thereof, said first drive link being further connected to said solenoid connecting link at a second end of said first drive link;

a closing prop driver connected to said second drive link at a second end of said closing prop driver, said closing prop driver having a closing prop drive post extending therefrom, whereby said driver post abuts a charging ratchet post on a circuit breaker charging ratchet to restrain rotation of said charging ratchet and prevent release of a charged contact closing spring.

2. The circuit breaker contact spring release assembly of claim 1 including a prop driving pin extending from said closing prop driver and a slot on an end of said second drive link, said prop driving pin being captured within said second drive link slot for moving said second drive link and said closing prop driver in unison when said solenoid becomes energized to draw said solenoid plunger and attached solenoid connecting link toward said solenoid and allow release of said charged contact closing spring.

3. The circuit breaker contact spring release assembly of claim 1 including:

a closing prop intermediate said prop driver and said first drive link;

a detent surface on said closing prop driver and an edge defined on said closing prop, said closing prop edge being arranged against said prop driver detent surface for causing said closing prop driver and said closing prop to rotate in unison.

4. A circuit breaker having a remote control function comprising:

a pair of separable contacts, said contacts being moved from OPEN to CLOSED conditions in response to discharge of a contact closing spring;

a contact closing spring charging shaft and a closing ratchet attached to said charging shaft, said closing ratchet and said charging shaft arranged for charging said closing spring;

a closing prop driver having a closing prop driver post extending therefrom and arranged for abutting with a charging bracket post extending from said closing ratchet for preventing rotation of said closing ratchet to release said closing spring and prevent moving said contacts from said OPEN to CLOSED condition;

a closing solenoid having a solenoid plunger and a solenoid connecting link attached to said solenoid plunger at one end; and a pair of first and second drive links connected to each other, said first drive link being further connected to said solenoid connecting link and said second drive link being further connected to said closing prop driver for causing said closing prop drive to move in unison when said solenoid is energized to draw said solenoid plunger and attached solenoid connecting link toward said solenoid and allow release of said charged contact closing spring.

5. The circuit breaker of claim 4 further including a prop driving pin extending from said closing prop driver and a slot on an end of said second drive link, said prop driving pin being captured within said second drive link slot for moving said second drive link and said closing prop driver in unison when said solenoid becomes energized to draw said solenoid plunger and attached solenoid connecting link toward said solenoid and allow release of said charged contact closing spring.

6. The circuit breaker of claim 5 including:

a closing prop intermediate said closing prop driver and said first drive link; and a detent surface on said closing prop driver and an edge defined on said closing prop, said closing prop edge being arranged against said prop driver detent surface for causing said closing prop driver and said closing prop to rotate in unison.

7. The circuit breaker contact release assembly of claim 1, further comprising:

a closing button assembly having a push rod with a button attached at one end, the push rod extending through a push rod guide for positioning an opposite second end of said push rod above a first end of said second drive link; and wherein said second drive link includes a bent tab at said first end, wherein actuation of said closing button assembly drives said second end of said push rod into contact with said bent tab to cause said second drive link to rotate and allow release of said charged contact closing spring.

8. The circuit breaker contact release assembly of claim 1, further comprising:

a closing button assembly comprising:

a push rod having a first end and an opposite second end, said first end having a button attached thereto; and a push rod guide, said push rod extending therethrough, wherein said push rod guide is disposed proximate said second drive link so that said second end of the push rod is disposed above a bent tab disposed at a first end of said second drive link, wherein said second end of said push rod is not in contact with said bent tab when said driver post abuts said charging ratchet post.

* * * * *